US008297003B2

(12) United States Patent
Kollegger et al.

(10) Patent No.: US 8,297,003 B2
(45) Date of Patent: Oct. 30, 2012

(54) GLIDING BED FOR CONCRETE SLABS, PROCESS FOR THE PRODUCTION OF A CONCRETE SLAB AND STRUCTURE WITH A GLIDING BED

(75) Inventors: Johann Kollegger, Klosterneuburg (AT); Anton Schweighofer, Wien (AT)

(73) Assignee: VSL International AG, Koeniz (CH)

( * ) Notice: Subject to any disclaimer, the term of this patent is extended or adjusted under 35 U.S.C. 154(b) by 563 days.

(21) Appl. No.: 12/520,382

(22) PCT Filed: Dec. 20, 2007

(86) PCT No.: PCT/AT2007/000578

§ 371 (c)(1),
(2), (4) Date: Jul. 23, 2009

(87) PCT Pub. No.: WO2008/077167

PCT Pub. Date: Jul. 3, 2008

(65) Prior Publication Data

US 2010/0015388 A1 Jan. 21, 2010

(30) Foreign Application Priority Data

Dec. 22, 2006 (AT) ..... A 2131/2006

(51) Int. Cl.
*E04B 1/35* (2006.01)

(52) U.S. Cl. ..... 52/126.5; 404/17; 404/27; 404/31; 404/75; 52/742.14; 52/2.22

(58) Field of Classification Search ..... 52/126.5, 52/2.22, 169.11, 169.14, 742.14, 742.13; 404/17, 27, 31, 75

See application file for complete search history.

(56) References Cited

U.S. PATENT DOCUMENTS

| | | | | | |
|---|---|---|---|---|---|
| 1,705,066 | A | * | 3/1929 | Sadtler | 404/28 |
| 1,706,077 | A | * | 3/1929 | Sadtler | 404/70 |
| 2,044,498 | A | * | 6/1936 | Pearce | 404/28 |
| 2,226,201 | A | * | 12/1940 | Eugene | 405/110 |
| 2,704,983 | A | * | 3/1955 | Dronkelaar | 109/1 S |
| 3,022,712 | A | * | 2/1962 | Cousino et al. | 472/92 |
| 3,040,411 | A | * | 6/1962 | Messenger | 405/229 |
| 3,057,270 | A | * | 10/1962 | Donovan | 264/34 |
| 3,683,760 | A | * | 8/1972 | Silva | 404/72 |
| 3,688,457 | A | * | 9/1972 | Sherno | 52/169.11 |
| 3,791,443 | A | * | 2/1974 | Burt et al. | 165/45 |
| 3,804,543 | A | * | 4/1974 | Best | 404/28 |
| 4,151,025 | A | * | 4/1979 | Jacobs | 156/71 |
| 4,399,645 | A | * | 8/1983 | Murphy et al. | 52/742.13 |
| 4,509,304 | A | * | 4/1985 | Epes | 52/127.3 |

(Continued)

FOREIGN PATENT DOCUMENTS

AT 286575 B 12/1970

(Continued)

*Primary Examiner* — Christine T Cajilig
(74) *Attorney, Agent, or Firm* — Workman Nydegger

(57) ABSTRACT

A gliding bed for a concrete slab comprises a first film and a second film wherein the first film can be brought into contact with a foundation of the concrete bottom slab and the second film can be brought into contact with a bottom side of the concrete slab by pouring concrete onto the second film and which films are tightly connected to each other at edges. In order to minimize friction between the concrete slab and the foundation, at least one gas- and liquid-permeable layer formed from a fleece and/or a textile fabric, a woven fabric or a knitted fabric is provided between the films.

25 Claims, 4 Drawing Sheets

U.S. PATENT DOCUMENTS

Figure 1:
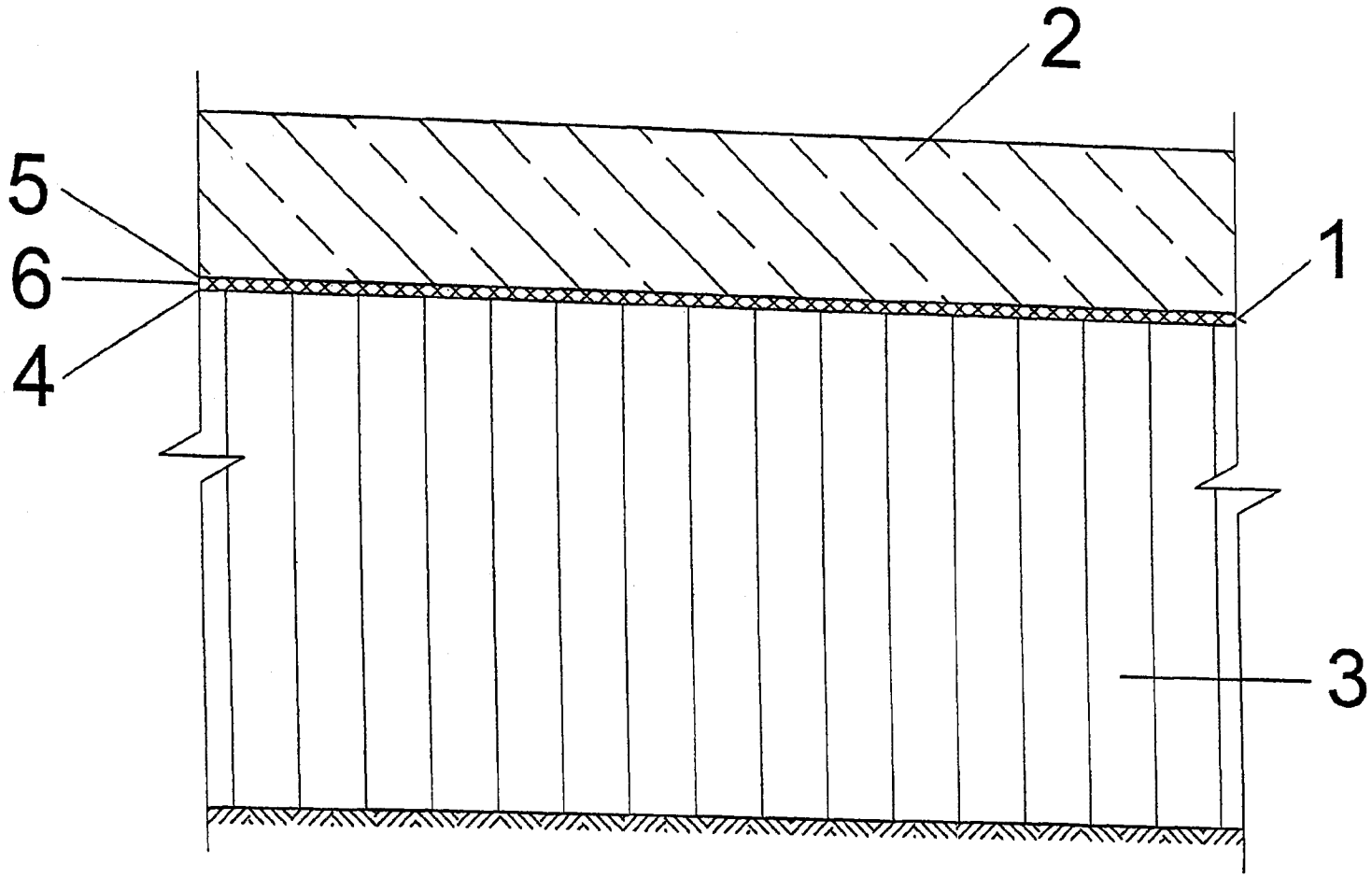

| | | | | |
|---|---|---|---|---|
| 4,647,258 | A * | 3/1987 | Massarsch | 405/302.5 |
| 5,024,552 | A * | 6/1991 | Baillemont et al. | 404/31 |
| 5,544,976 | A * | 8/1996 | Marchbanks | 405/129.6 |
| 5,887,397 | A * | 3/1999 | Repasky | 52/302.4 |
| 6,732,763 | B2 * | 5/2004 | Williamson et al. | 138/98 |
| 6,898,907 | B2 * | 5/2005 | Diamond | 52/202 |
| 6,988,852 | B2 * | 1/2006 | Bussey et al. | 405/38 |
| 7,219,479 | B2 * | 5/2007 | Durning et al. | 52/746.1 |
| 2001/0002497 | A1 * | 6/2001 | Scuero | 14/73 |
| 2007/0206994 | A1 * | 9/2007 | Olsta et al. | 405/128.45 |
| 2009/0031659 | A1 * | 2/2009 | Kalfon | 52/404.1 |

FOREIGN PATENT DOCUMENTS

| | | | |
|---|---|---|---|
| DE | 1153788 | B | 9/1963 |
| DE | 1534351 | A1 | 7/1969 |
| DE | 3110684 | A1 | 10/1982 |
| EP | 1087069 | A2 | 3/2001 |

* cited by examiner

GLIDING BED FOR CONCRETE SLABS, PROCESS FOR THE PRODUCTION OF A CONCRETE SLAB AND STRUCTURE WITH A GLIDING BED

The invention concerns a gliding bed for concrete slabs and a process for the production of a concrete slab, wherein the gliding bed comprises a first film and a second film, the first film can be brought into contact with a foundation of the concrete slab and the second film can be brought into contact with a bottom side of the concrete slab by pouring concrete onto the second film and which films are tightly connected to each other at edges.

During the production of concrete slabs, in particular of bottom slabs made of concrete or fibre concrete, joints are to be provided at a distance of from 5 m to 8 m in order to be able to absorb contractions as a result of a discharge of hydration heat, shrinkage and a temperature drop in the joints and to avoid rupture of the slab fields. The joints have the disadvantage of being high-maintenance and susceptible to damage.

Relatively large bay widths of approx. 20 m are possible with reinforced bottom slabs made of concrete, if the reinforcement is dimensioned such that the above-mentioned contractions are absorbed by controlled cracking inside the slab fields. This, however, has the disadvantage that cracking may continue also on the surface and the use of a reinforcement is complicated and expensive.

For the construction of concrete slabs which are as crack-free as possible and of larger fields, respectively, it is furthermore known to pretension them. In doing so, however, the problem arises that pretensioning must be applied as early as possible (prior to the discharge of hydration heat), but the concrete does not yet exhibit sufficient strength at this point in time. Therefore, the concrete slab is charged gradually with the pretensioning (a so-called partial pretensioning). The pretensioning of the concrete slab causes a contraction for which a capability of the concrete slabs to glide freely on the foundation is to be ensured.

Said capability to glide is counteracted by frictional forces which depend on the weight of the concrete slab, the coefficient of friction between the concrete slab and the foundation and the distance between the tie point and a motional resting point of the concrete slab. The pretensioning force acting on the concrete slab decreases as the distance from the tie point increases and is zero at a certain distance and thus ineffective.

For avoiding such problems, it is known, for example, to reduce the coefficient of friction between the concrete slab and the foundation by arranging a layer of sand with a thickness ranging from 2 cm to 5 cm as well as two layers of PE films, one or several bituminous separating layers or sliding films on a concrete subbase between the concrete slab and the foundation.

Published patent application DE 31 10 684 A1 shows a gliding bed of a concrete slab extended in one or two directions, which concrete slab rests on a further concrete slab or on compacted soil, with said concrete slab resting on point bearing strips or on line bearing strips and, between those bearing strips, on an air cushion layer.

A disadvantage of the latter arrangement is an only insufficient improvement of the sliding friction caused by the escape of air from the air cushions, whereupon the concrete slab rests with high forces of surface pressure on small bearing areas, as well as the large effort involved in the production of such an arrangement.

A bed of the initially mentioned kind is shown, for example, in DE 1 153 788 A, which discloses a gliding bed film in the form of a thin-walled tube arranged between two concrete slabs or between a concrete slab and the foundation, respectively.

Disadvantages in this connection are, in particular, that the films may be damaged by intermediate layers of sand or the like, that the sliding friction properties are only insufficient and also that the gliding properties are uncontrollably influenced by water entering between the films or between the film and the concrete.

From U.S. Pat. No. 3,057,270 A, a gliding bed for a concrete slab is known, wherein a membrane is applied on a foundation and a layer of sand is provided on said membrane, which layer of sand is covered by a ply of building paper. The edges of the membrane are folded up before the concrete is poured, whereby they overlap the building paper so that a closed border is thereby formed.

It is the object of the invention to indicate a gliding bed for concrete slabs and a process for the production of a concrete slab which enables the manufacture of large jointless concrete slabs by selectively reducing the frictional forces between the concrete slab and the foundation.

The object is achieved by a gliding bed of the initially described kind in that at least one gas- and liquid-permeable layer formed from a fleece and/or a textile fabric, a woven fabric or a knitted fabric is provided between the films.

The at least one gas- and/or liquid-permeable layer thereby provides for a low-friction bedding of the concrete slab, which enables a uniform, stressfree curing of the concrete slab after the pouring process. Thus, also large areas can be covered with concrete without compensating joints in such a way that tension cracks will not occur even permanently.

A process for the production of a concrete slab, preferably a concrete bottom slab, using a gliding bed comprises the following steps: placing a first film preferably on the foundation of a concrete bottom slab, placing at least one gas- and liquid-permeable layer, formed from a fleece and/or a textile fabric, a woven fabric or a knitted fabric, on the first film, covering the at least one layer with the second film, hermetically interconnecting the films at their edges, concreting the concrete slab on the gliding bed, introducing a liquid or gaseous medium into the gliding bed at a predetermined minimum pressure and maintaining the minimum pressure in the gliding bed until the concrete slab has cured.

The process is thereby characterized by a simple and highly efficient possibility of manufacturing also large concrete slabs without tension cracks.

A structure comprising a foundation, a gliding bed and a concrete bottom slab is characterized in that the gliding bed comprises a first film and a second film, which films are tightly connected to each other at edges and between which films at least one gas- and liquid-permeable layer formed from a fleece and/or a textile fabric, a woven fabric or a knitted fabric is formed, wherein the first film lies on the foundation of the concrete bottom slab and the second film lies on a bottom side of the concrete bottom slab by pouring concrete onto the second film, with a hardened medium advantageously being present between the films.

Figure 2:
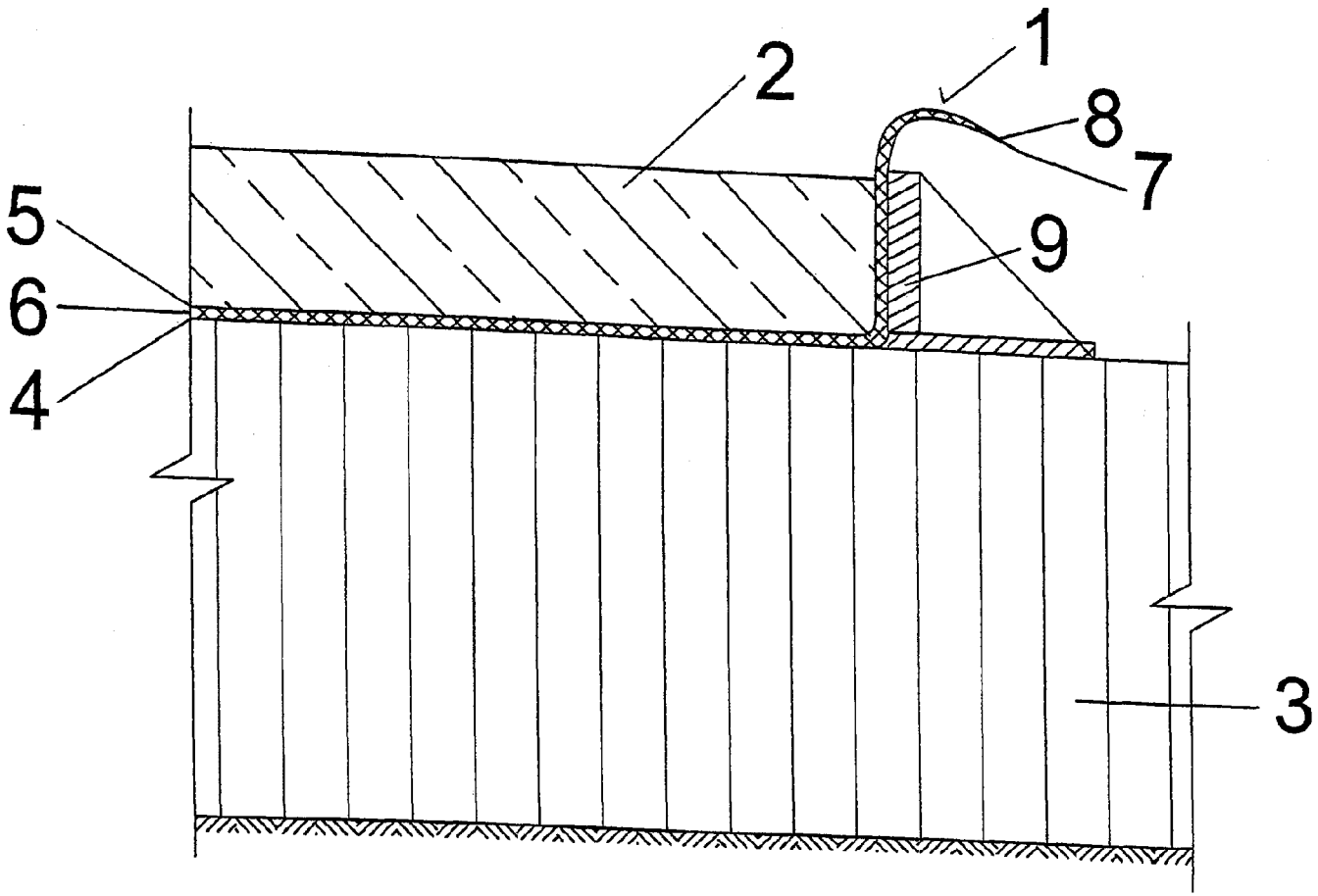
Figure 3:
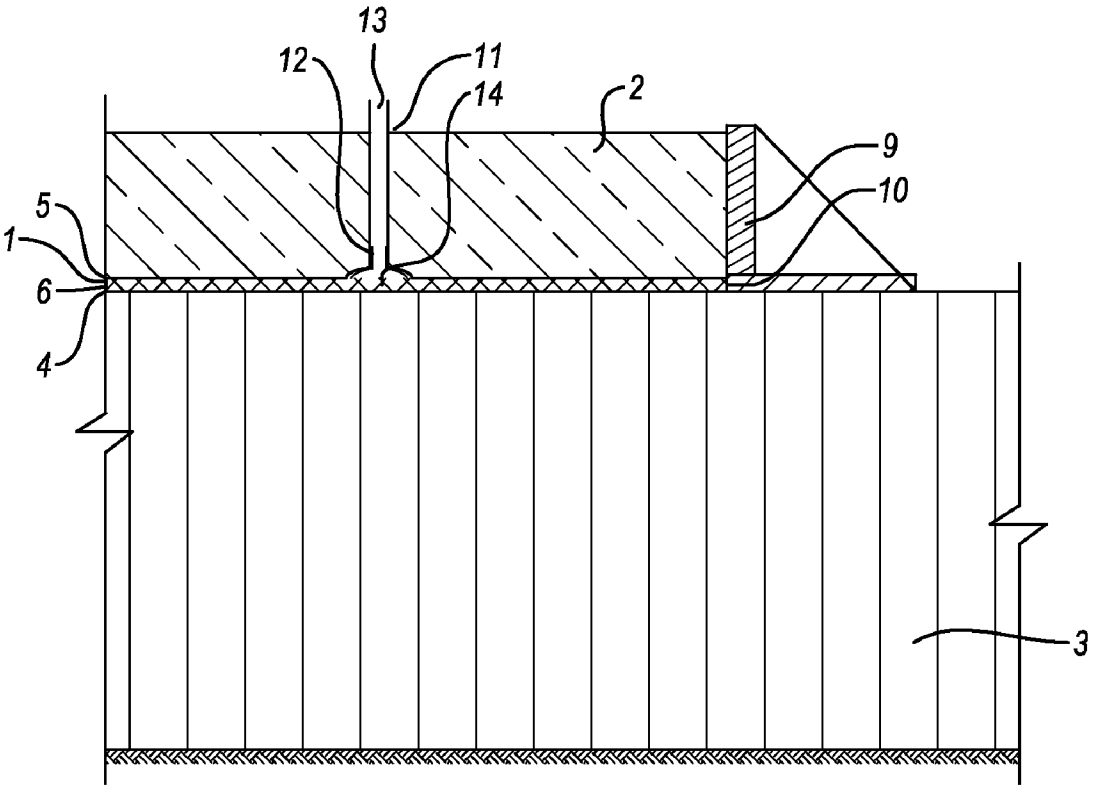

In the following, exemplary embodiments of the invention are depicted on the basis of the figures and illustrated further in the associated description. In the figures:

FIG. 1 shows a highly schematized sectional view through an exemplary embodiment of a gliding bed for a concrete bottom slab, which gliding bed has been designed according to the invention, FIG. 2 shows a highly schematized illustration of the edge design of the exemplary embodiment depicted in FIG. 1 of a gliding bed according to the invention, and FIG. 3 shows a highly schematized illustration of a filling point for the gliding bed according to the invention.

Figure 4:
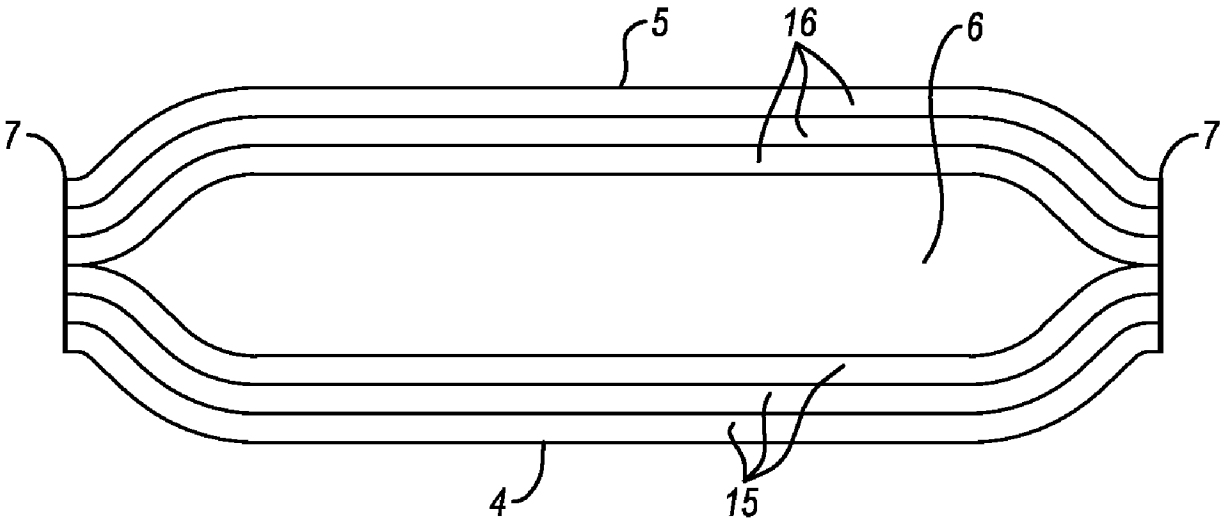

FIG. 4 illustrates that the films of the gliding bed include multiple layers.

In FIG. 1, a highly schematized gliding bed 1 between a concrete bottom slab 2 and a foundation 3 is illustrated. The foundation 3 may be made, for example, of concrete or another suitable material, as illustrated in the figures, or merely of compacted soil.

The gliding bed 1 according to the invention, which comprises a first film 4, a second film 5 and at least one layer 6 arranged between the films 4, 5 and permeable to gases and/or liquids, is arranged between the concrete bottom slab 2 and the foundation 3. The permeable layer 6 may thereby be formed from individual fibres in the form of a cloth, in particular a fleece or another suitable textile fabric. Woven fabrics and knitted fabrics made of yarns with appropriate gas- and/or liquid-permeable properties may also be used for the at least one permeable layer 6.

The first and second films 4, 5 are interconnected all around at their edges 7, for example, plastic-welded, so that a hermetically sealed space is created between the two films 4, 5. A weld 8 of this kind is illustrated, e.g., in FIG. 2. In addition, the gliding bed 1 may be bent upwards in its edge regions, as can be seen in FIG. 2, and be supported by a peripheral enclosure 9, which may be designed, for example, in the form of an L-shaped angle profile, wherein the peripheral enclosure 9 may be connected to the foundation 3. Furthermore, it is thereby ensured that the concrete bottom slab 2 is reliably supported during the curing process. The formation of cracks in the concrete bottom slab 2 caused by the concrete running apart can also be prevented by the peripheral enclosure 9.

As can be seen in FIG. 3, the manufacture of the gliding bed 1 can also be simplified in that the first film 4 is folded back on itself and on the at least one permeable layer 6, respectively, which has been placed thereon, so that the first film 4 and the second film 5 constitute two layers of the same plastic web, which are connected to each other at an edge 10. As a result, the weld 8 at one of the edges 7 can be omitted, whereby the expenditures and costs of manufacture can be reduced.

The gliding bed 1 is produced in the manner described below:

At first, the first film 4 is placed on the foundation 3 or subsurface, respectively, then covered with the at least one permeable layer 6, which is covered with the second film 5. Several layers 6 or film layers 4, 5, respectively, may also be provided in each case. Sandwich construction is conceivable as well, wherein the air spaces formed between the films 4, 5 may be connected to each other or also sealed from each other.

Then, the films 4, 5 are hermetically connected to each other at their edges 7, as has been described above. Thereupon, the concrete bottom slab 2 can be concreted on the gliding bed 1. Shortly after the concrete bottom slab 2 has been concreted, a liquid or gaseous medium 14, a gas or a fluid, is introduced into the at least one permeable layer 6 between the two films 4, 5 and, in this way, a minimum pressure is produced which carries the concrete bottom slab 2 and thereby supports it in deformation processes during the hardening of the concrete bottom slab 2. The minimum pressure is maintained for at least so long until a part of the shrinkage contraction of the concrete bottom slab 2 has set in, until the hydration heat has flown off and, respectively, until the concrete bottom slab 2 has again adopted the ambient temperature.

The gliding bed 1 can be placed on the foundation 3 also as a prefabricated product so that the films 4, 5 are delivered with the at least one intermediate layer 6 for example as continuous goods and are then merely cut to size and welded in situ.

In one example, the medium present in the at least one layer is replaced at least partially by a different medium. In one example, the pressure in the layer is maintained until the concrete slab has reached ambient temperature. In one example, the medium undergoes a change in its physical properties by a chemical reaction during or after the discharge of the hydration heat and during or after the onset of the shrinkage contraction of the concrete slab. In one example, the medium is at first provided in a liquid state and, after completion of a polymerization reaction, forms a permanent, preferably elastic structure. Also, the change of the medium is influenceable by the action of heat, in particular by utilization of the hydration heat or by enhanced heating after the concrete slab has cured.

The pressure in the gliding bed 1 can also be combined with a pretensioning of the concrete bottom slab 2, in which case the gliding bed 1 is charged with the pressure before the concrete bottom slab 2 is charged with a pretensioning. Central pretensioning may occur in addition so that the distortions as a result of the shrinkage and the temperature drop are smaller than the upsetting of the concrete bottom slab 2 by the pretensioning.

In order to achieve uniform bedding, the medium pressure in the layer 6 should be equal to 0.3 to 1.1 times, preferably 0.8 to 1.0 times, the dead weight of the concrete bottom slab 2. Suitable materials such as cement mortar or thixotropic fluids or also a suction facility for sucking off the medium 14 present in the layer 6 may be used for pressing out the medium 14 in the permeable layer 6. It is also possible that the medium 14 remains in the gliding bed 1, hardening to an elastic damping layer.

As can be seen in FIG. 3, one or several filling points 11 may be provided for introducing the medium 14 into the permeable layer 6, which filling points may be designed, for example, in the form of a filling valve 12 in the film 4. The at least one filling valve 12 extends at least partially into at least one recess 13 in the concrete bottom slab 2, which penetrates the concrete bottom slab 2, through which a connection to a filling device can be attached to the filling valve 12. The concrete bottom slab 2 thus exhibits only one or several small recesses 13, which, in addition, may be designed so as to be sealable in a simple manner so that a very homogeneous formation of the surface of the concrete bottom slab 2 is possible.

The films 4, 5 thereby consist preferably of polyethylene, polypropylene or polyvinyl chloride and exhibit, per film layer, a tear strength of at least 5N/cm in the longitudinal and transverse directions. The tensile strength per film layer should amount to at least 2000N/cm$^2$ in the longitudinal and transverse directions. The elongation at break is determined to be up to 400% per film layer in the longitudinal and transverse directions.

The layer 6 preferably consists of polypropylene or polyester with a weight ranging from 100 to 500 g/m$^2$ per layer 6. The thickness of each individual layer 6 preferably ranges between 1 mm and 4 mm The maximum tractive forces per layer 6 preferably range between 9.5 and 30 kN/m. The water permeability of the layer 6 is determined to have a value of approx. $3 \cdot 10^{-3}$.

The gas- and/or liquid-permeable layer 6 thereby has a modulus of elasticity which is normal to the centre plane of the layer 6. If the dead weight of the concrete slab 2 is compensated by air or water pressure in the layer 6, the layer 6, which was compressed by the dead weight of the concrete slab 2, will regain its original thickness dimension, assuming that there is a linearly elastic material behaviour in the layer 6 normal to the centre plane of the layer 6. This effect can be favourable if unevenness in the subsurface during the deformations of the concrete slab 2 (e.g., during pretensioning, because of the discharge of hydration heat, cutting or temperature) is to be levelled out by a sufficient thickness of the layer 6, e.g., using several layers of fleece.

Furthermore, it may be advantageous to increase the pressure in the layer 6 at certain points in time during the service life of the concrete slab 2 in order to relieve frictional forces which have meanwhile arisen between the concrete slab 2 and the subsurface 3, for example, due to contractions of the concrete slab 2 as a result of shrinkage or creep in a pretensioned concrete slab 2. This works particularly well with concrete slabs 2 which do not carry any high permanent burdens, i.e., for example, with roads or airstrips and runways.

The at least one layer 6 prevents the two films 4, 5 from possibly sticking together, e.g., because of moisture; the air can expand slowly and uniformly in the at least one layer 6.

FIG. 4 illustrates that the films of the gliding bed include multiple layers. The film 4 may include multiple layers 15 and the film 5 may include multiple layers 16. Each of the layers 15 may be the film 4 or the film 5 and each of the layers 16 may be the film 4 or the film 5.

The invention is not restricted to the illustrated exemplary embodiments, but comprises also the production of a concrete slab which is lifted from the gliding bed after having cured thereon and is used for structures of any kind.

The invention claimed is:

1. A gliding bed for a concrete slab, the gliding bed comprising:
- a first film; and
- a second film,
- wherein the first film is configured to be brought into contact with a foundation of the concrete slab and the second film is configured to be brought into contact with a bottom side of the concrete slab by pouring concrete onto the second film,
- wherein the first film and the second film are tightly connected to each other at their edges,
- wherein at least one gas- and liquid-permeable layer formed from a fleece and/or a textile fabric, a woven fabric or a knitted fabric is provided between the first film and the second film,
- wherein the first film, the second film and the at least one gas- and liquid-permeable layer are configured to reduce a friction between the concrete slab and the foundation when the concrete slab is subject to movement,
- wherein the first film and the second film are configured to maintain a positive pressure in the gliding bed.

2. A gliding bed according to claim 1, wherein the at least one gas- and liquid-permeable layer is formed from polypropylene or polyester.

3. A gliding bed according to claim 1, wherein the first film and/or the second film is/are designed in multiple layers.

4. A gliding bed according to claim 1, wherein the films are formed from polyethylene, polypropylene or polyvinyl chloride.

5. A gliding bed according to claim 1, further comprising a liquid or gaseous medium introduced into the gliding bed through at least one filling point.

6. A gliding bed according to claim 5, wherein the at least one filling point is provided with a filling valve in the second film facing the concrete slab.

7. A gliding bed according to claim 6, wherein, the at least one filling valve is configured to be accessed through at least one recess penetrating the concrete slab.

8. A gliding bed according to claim 6 or 7, wherein a filling device can be attached to the at least one filling valve.

9. A gliding bed according to claim 1, wherein the gliding bed terminates flush with the concrete slab.

10. A gliding bed according to claim 1, wherein the gliding bed continues between the concrete slab and a peripheral enclosure having an L profile and a dimension of the concrete slab to be formed.

11. A process for the production of a concrete bottom slab using a gliding bed, the process comprising:
- placing a first film on a foundation of a concrete slab,
- placing at least one gas- and liquid-permeable layer, formed from a fleece and/or a textile fabric, a woven fabric or a knitted fabric, on the first film,
- covering the at least one gas- and liquid-permeable layer with a second film,
- wherein the first film, the at least one gas- and liquid-permeable layer, and the second film form the gliding bed,
- hermetically interconnecting the first film and the second film at their edges, concreting the concrete slab on the gliding bed,
- introducing a liquid or gaseous medium into the gliding bed at a predetermined minimum pressure, and
- maintaining the minimum pressure in the gliding bed until the concrete slab has cured.

12. A process according to claim 11, wherein the medium is left in the layer, while the medium hardens.

13. A process according to claim 11, wherein pressing out or conveying out the medium present in the at least one layer follows as a further processing step, after the concrete has cured at least partially.

14. A process according to claim 11, wherein a further processing step follows in which the medium present in the at least one layer is replaced at least partially by a different medium.

15. A process for the production of a concrete bottom slab using a gliding bed, the process comprising:
- placing a first film on a subsurface,
- placing at least one gas- and liquid-permeable layer, formed from a fleece and/or a textile fabric, a woven fabric or a knitted fabric, on the first film,
- covering the at least one gas- and liquid-permeable layer with a second film,
- wherein the first film, the at least one gas- and liquid-permeable layer, and the second film form the gliding bed,
- hermetically connecting the first film and the second film at their edges, subsequently, placing the gliding bed formed from the first and second films and the intermediate layer on a foundation of the concrete slab to be produced,
- concreting the concrete slab on the gliding bed,
- introducing a liquid or gaseous medium into the gliding bed at a predetermined minimum pressure, and
- maintaining the minimum pressure in the gliding bed until the concrete slab has cured.

16. A process according to claim 11 or 15, wherein the medium is introduced into the gliding bed at a pressure which is equal to 0.3 to 1.1 times or 0.8 to 1.0 times, the dead weight of the concrete slab.

17. A process according to claim 11 or 15, wherein the pressure build-up in the layer occurs prior to the discharge of the hydration heat of the concrete slab.

18. A process according to claim 17, wherein the pressure in the layer is maintained until the concrete slab has reached ambient temperature.

19. A process according to claim 11 or 15, wherein the pressure build-up in the layer occurs prior to an application of pretensioning to the concrete slab.

20. A process according to claim 11 or 15, wherein the medium undergoes a change in its physical properties by a chemical reaction during or after the discharge of the hydration heat and during or after the onset of the shrinkage contraction of the concrete slab.

21. A process according to claim 11 or 15, wherein the medium is at first provided in a liquid state and, after completion of a polymerization reaction, forms a permanent, elastic structure.

22. A process according to claim 11 or 15, wherein the change of the medium is influenceable by the action of heat, in particular by utilization of the hydration heat or by enhanced heating after the concrete slab has cured.

23. A process according to any claim 11 or 15, wherein the medium is a thixotropic gel.

24. A structure comprising a foundation, a gliding bed and a concrete bottom slab, wherein the gliding bed comprises:

a first film and a second film, wherein the first film and the second film are tightly connected to each other at edges; and at least one gas- and liquid-permeable layer formed from a fleece and/or a textile fabric, a woven fabric or a knitted fabric is formed between the first film and the second film, wherein the first film lies on the foundation of the concrete bottom slab and the second film lies on a bottom side of the concrete bottom slab by pouring concrete onto the second film, wherein the first film, the second film and the at least one gas- and liquid-permeable layer are configured to reduce a friction between the concrete slab and the foundation, wherein the first film and the second film are configured to maintain a pressure.

25. A structure according to claim 24, wherein a hardened medium, of an elastic nature, is present between the films.

* * * * *